US012072131B2

(12) United States Patent
Rite

(10) Patent No.: US 12,072,131 B2
(45) Date of Patent: Aug. 27, 2024

(54) HEAT EXCHANGER DESIGN FOR CLIMATE CONTROL SYSTEM

(71) Applicant: Trane International Inc., Davidson, NC (US)

(72) Inventor: Raymond Walter Rite, Tyler, TX (US)

(73) Assignee: Trane International Inc., Davidson, NC (US)

( * ) Notice: Subject to any disclaimer, the term of this patent is extended or adjusted under 35 U.S.C. 154(b) by 48 days.

(21) Appl. No.: 17/805,411

(22) Filed: Jun. 3, 2022

(65) Prior Publication Data

US 2023/0392843 A1 Dec. 7, 2023

(51) Int. Cl.
*F25B 49/02* (2006.01)
*F25B 13/00* (2006.01)
(Continued)

(52) U.S. Cl.
CPC ..... *F25B 49/02* (2013.01); *F25B 13/00* (2013.01); *F25B 39/00* (2013.01); *F25B 41/20* (2021.01);
(Continued)

(58) Field of Classification Search
CPC ..... F25B 49/02; F25B 41/20; F25B 13/00; F25B 39/00; F25B 43/006; F25B 2400/04;
(Continued)

(56) References Cited

U.S. PATENT DOCUMENTS 5,996,364 A 12/1999 Lifson
6,058,729 A 5/2000 Lifson
(Continued)

FOREIGN PATENT DOCUMENTS

CN 210892262 U * 6/2020
EP 0778451 A2 1/1998
(Continued)

OTHER PUBLICATIONS

Kim et al., Air Conditioner, May 30, 2018, KR20180056862A, Whole Document (Year: 2018).*
(Continued)

*Primary Examiner* — Larry L Furdge
(74) *Attorney, Agent, or Firm* — WOMBLE BOND DICKINSON (US) LLP

(57) ABSTRACT

Example embodiments of the present disclosure relate to a climate control system and methods for controlling the system. Some embodiments include a system that includes a refrigerant circuit with both a main circuit and a bypass circuit, where the main circuit directs the refrigerant fluid from a compressor to a first heat exchanger, a metering device, a second heat exchanger, and an accumulator, and the bypass circuit selectively directs a portion of the refrigerant fluid to a third heat exchanger. The bypass circuit includes a bypass control valve and a bypass metering device, the bypass control valve controlling the flow of the portion of the refrigerant fluid to be directed to the third heat exchanger, and the bypass metering device lowering the temperature of the portion of the refrigerant fluid before the portion of the refrigerant fluid enters the third heat exchanger. The third heat exchanger may be located proximate the accumulator.

18 Claims, 10 Drawing Sheets

(51) Int. Cl.
*F25B 39/00* (2006.01)
*F25B 41/20* (2021.01)
*F25B 43/00* (2006.01)

(52) U.S. Cl.
CPC ..... *F25B 43/006* (2013.01); *F25B 2400/04* (2013.01); *F25B 2400/13* (2013.01); *F25B 2600/2501* (2013.01); *F25B 2700/2106* (2013.01)

(58) Field of Classification Search
CPC ..... F25B 2400/13; F25B 2600/2501; F25B 2700/2106
See application file for complete search history.

(56) References Cited

U.S. PATENT DOCUMENTS

| | | | | |
|---|---|---|---|---|
| 6,474,087 | B1 | 11/2002 | Lifson | |
| 7,114,349 | B2 | 10/2006 | Lifson | |
| 8,899,058 | B2 | 12/2014 | Unezaki | |
| 9,797,610 | B2 | 10/2017 | Yamashita | |
| 10,393,417 | B2 | 8/2019 | Wei | |
| 2006/0213220 | A1* | 9/2006 | Takahashi | B60H 1/3227 62/503 |
| 2007/0028646 | A1* | 2/2007 | Oshitani | F25B 41/00 62/170 |
| 2007/0261433 | A1* | 11/2007 | Mikita | F25B 40/00 62/503 |
| 2014/0182329 | A1 | 7/2014 | Yamashita | |
| 2015/0107290 | A1* | 4/2015 | Hatomura | F25B 41/00 62/324.6 |
| 2018/0306473 | A1 | 10/2018 | Wei | |

FOREIGN PATENT DOCUMENTS

| | | | |
|---|---|---|---|
| JP | 2007278688 | A * | 10/2007 |
| KR | 20180037644 | A * | 4/2018 |
| KR | 20180056862 | A * | 5/2018 |

OTHER PUBLICATIONS

Sun, Air Source Heat Pump, Jun. 30, 2020, CN210892262U, Whole Document (Year: 2020).*
Koester et al., Internal Heat Exchanger Having Spiral Standardized Fin Tube, Oct. 25, 2007, JP2007278688A, Whole Document (Year: 2007).*
Hwi et al., Air Conditioner, Apr. 13, 2018, KR20180037644A, Whole Document (Year: 2018).*

* cited by examiner

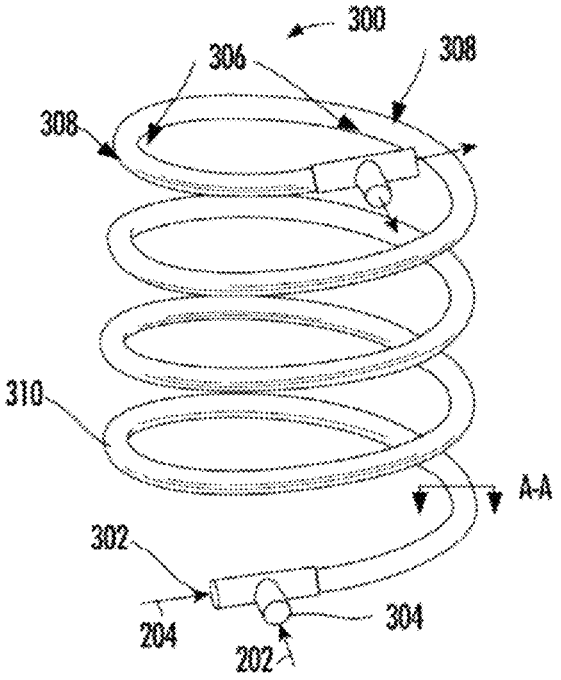
FIG. 3A
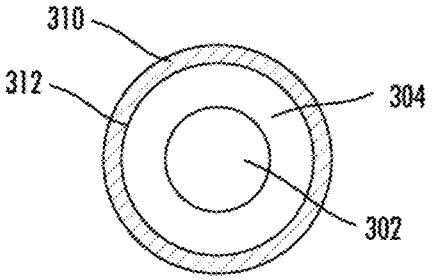
FIG. 3B (A-A)
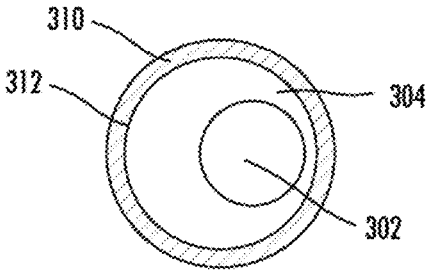
FIG. 3C (A-A)

HEAT EXCHANGER DESIGN FOR CLIMATE CONTROL SYSTEM

TECHNOLOGICAL FIELD

The present disclosure relates generally to an improved device and method for operating and arranging a climate control system with an economizer heat exchanger.

BACKGROUND

Various climate control systems exist and several of these systems are able to provide both heating and cooling. These systems use various refrigerant circuits to transport thermal energy between components of the system. Each of these designs offer various advantages, and typically provide for conditioning over a given temperature range. A common form of these systems, often referred to as a heat pump, uses a single reversible refrigerant circuit that moves thermal energy between two heat exchangers to provide heating and/or cooling as desired.

Single circuit heat pumps can struggle to maintain heating capacity when outdoor ambient temperatures drop significantly. While some more complex designs exist that utilize multiple circuits and potentially multiple heat exchangers, for example cascade systems, the resulting systems are often impractical for various reasons, e.g., size, costs, performance, etc.

As a result, there exists a need for an improved climate control system that minimizes complexity while maintaining heating performance at low ambient temperatures.

BRIEF SUMMARY

The present disclosure addresses the deficiencies described above and provides an improved design for a climate control system with an economizer heat exchanger. In some example implementations the economizer heat exchanger is coupled to an accumulator of a climate control system, which may provide advantageous packaging designs along with thermal efficiencies. In some examples, the economizer heat exchanger is designed as a tube-in-tube heat exchanger. In some examples, the economizer heat exchanger may be in a helix shape, and in some of these examples, the helical shape is wrapped around and/or coupled to the accumulator.

The present disclosure thus includes, without limitation, the following example embodiments.

Some example implementations provide a climate control system comprising: a refrigerant circuit configured to route a refrigerant fluid within the climate control system, the refrigerant circuit including a main circuit and a bypass circuit; the main circuit configured to direct the refrigerant fluid from a compressor to a first heat exchanger, a metering device, a second heat exchanger, and an accumulator; the bypass circuit configured to selectively direct a portion of the refrigerant fluid from a location between the first and second heat exchangers to a third heat exchanger, the bypass circuit including a bypass control valve and a bypass metering device, the bypass control valve configured to control the flow of the portion of the refrigerant fluid to be directed to the third heat exchanger, the bypass metering device configured to lower the pressure of the portion of the refrigerant fluid before the portion of the refrigerant fluid enters the third heat exchanger; and the third heat exchanger located proximate the accumulator and configured to exchange thermal energy between the portion of the refrigerant fluid and the refrigerant fluid in the main circuit while the portion of the refrigerant fluid is flowing in the bypass circuit.

Some example implementations provide a method of controlling refrigerant fluid flow in a climate control system, the method comprising: circulating a refrigerant fluid in a refrigerant circuit of the climate control system using a compressor, the refrigerant circuit including a main circuit and a bypass circuit; directing the refrigerant fluid in the main circuit from the compressor to a first heat exchanger, a metering device, a second heat exchanger, and an accumulator; selectively directing a portion of the refrigerant fluid through the bypass circuit from a location between the first and second heat exchangers to a third heat exchanger using a bypass control valve, the third heat exchanger located proximate the accumulator lowering the pressure of the portion of the refrigerant fluid before the portion of the refrigerant fluid enters the third heat exchanger using a bypass metering device; and exchanging thermal energy between the portion of the refrigerant fluid and the refrigerant fluid in the main circuit at the third heat exchanger while the portion of the refrigerant fluid is circulating in the bypass circuit.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

FIG. 3A is an illustration of an economizer heat exchanger, according to an example embodiment of the present disclosure;

FIG. 3B is an illustration of a cross section of an economizer heat exchanger, according to an example embodiment of the present disclosure;

FIG. 3C is an illustration of another cross section of an economizer heat exchanger, according to an example embodiment of the present disclosure;

Figure 4A:
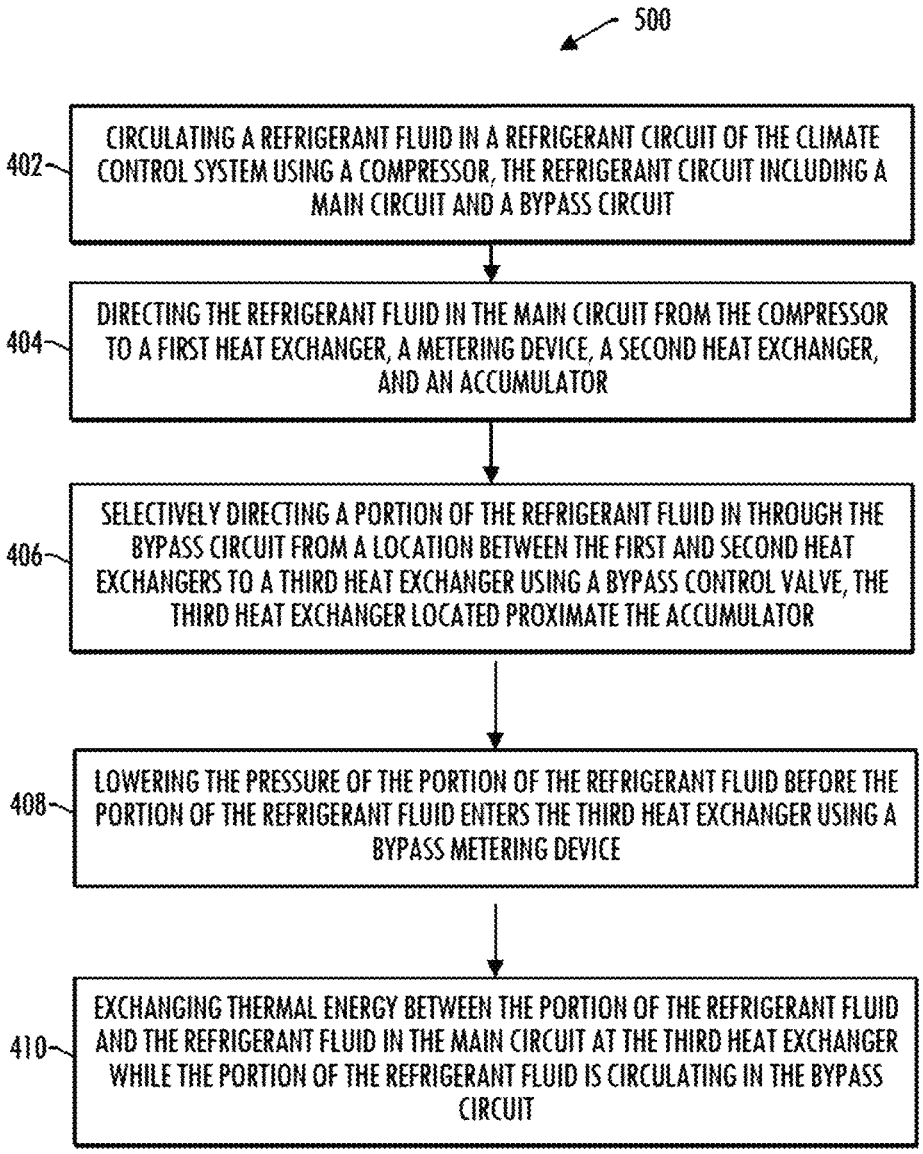
Figure 4B:
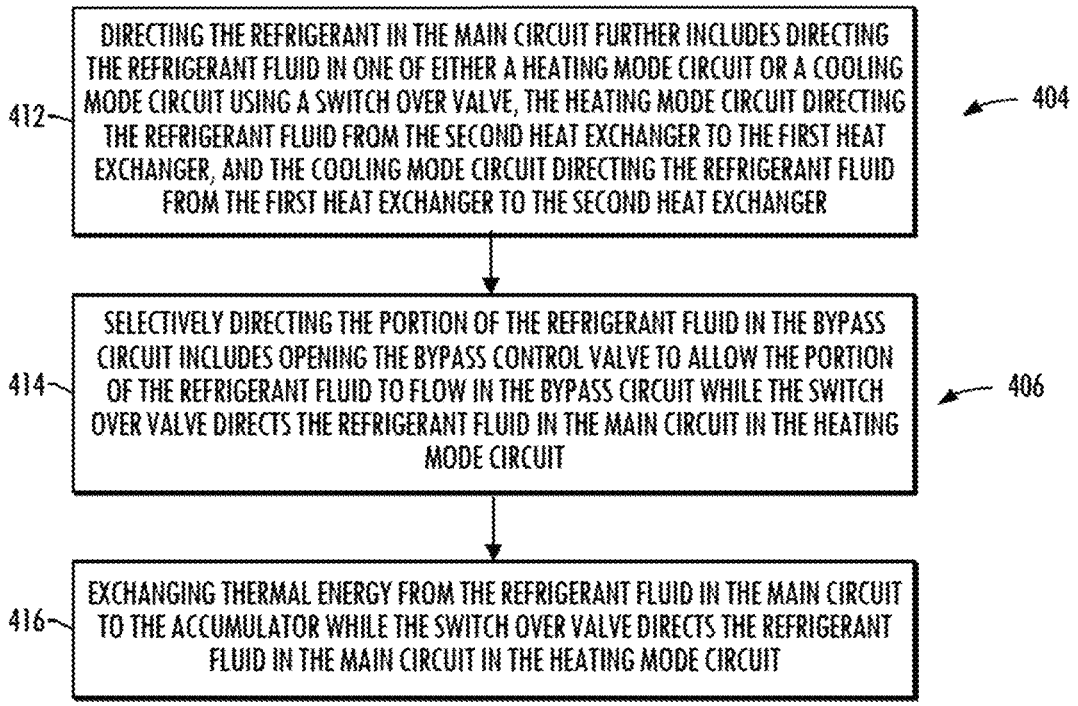
Figure 4C:
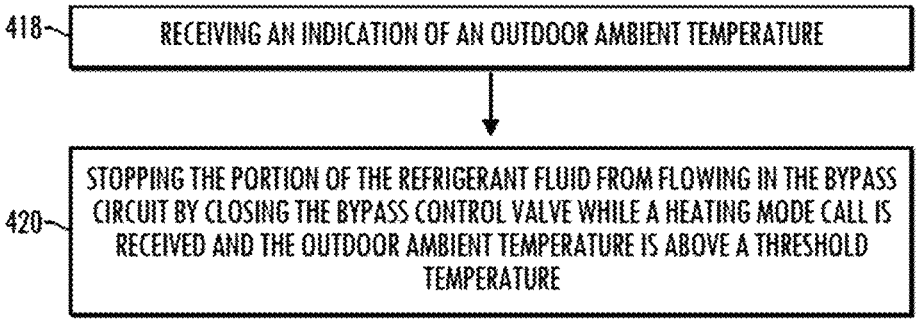
Figure 4D:
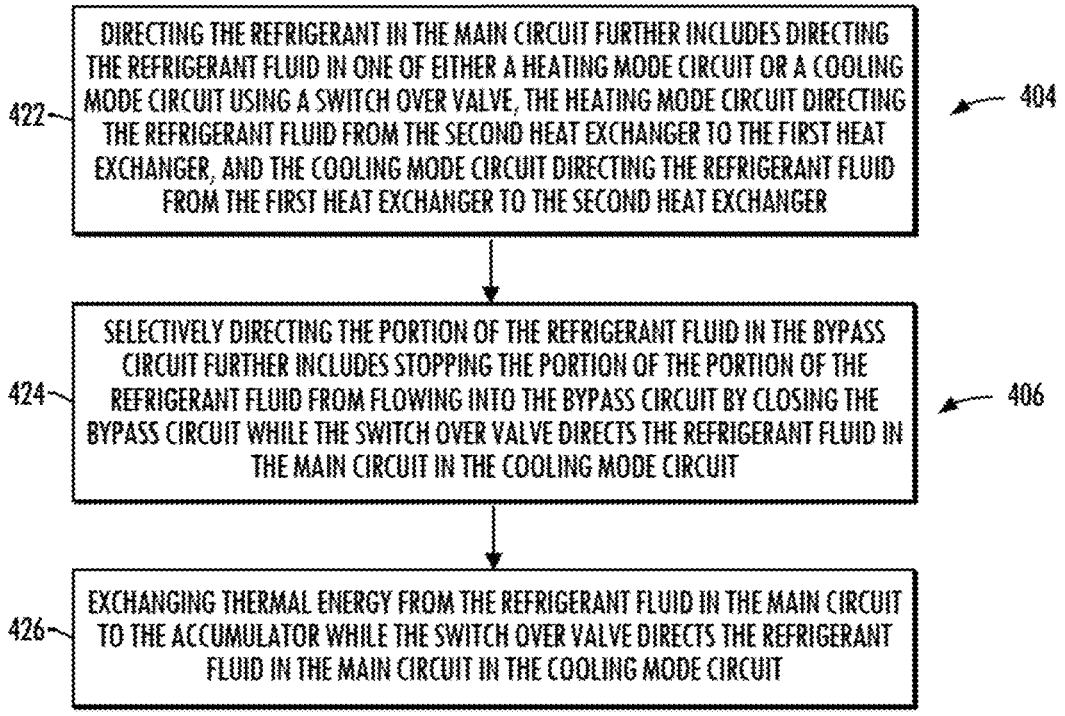
Figure 4E:
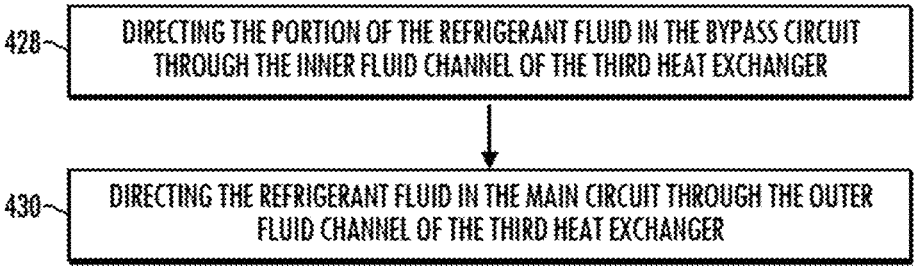
Figure 4F:
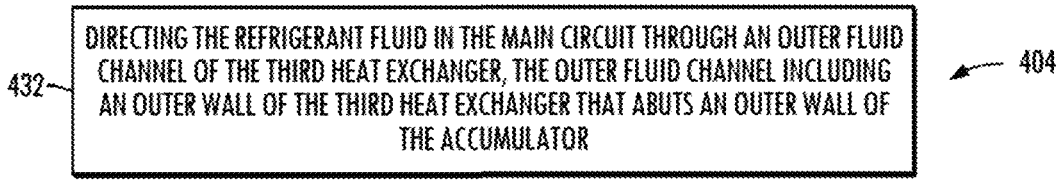
Figure 4G:
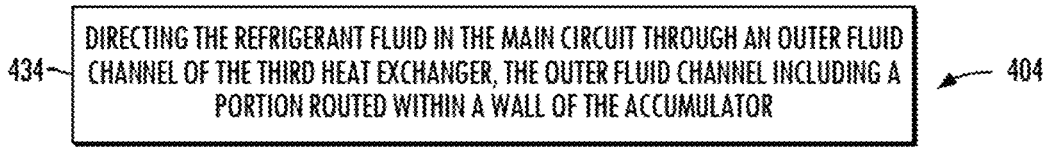
Figure 4H:
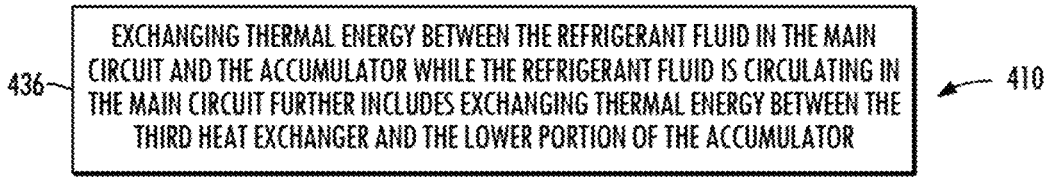
Figure 4I:
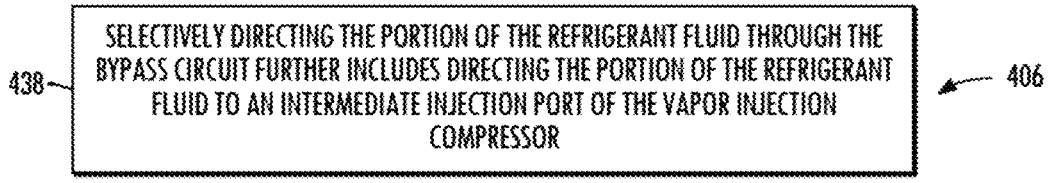
Figure 5:
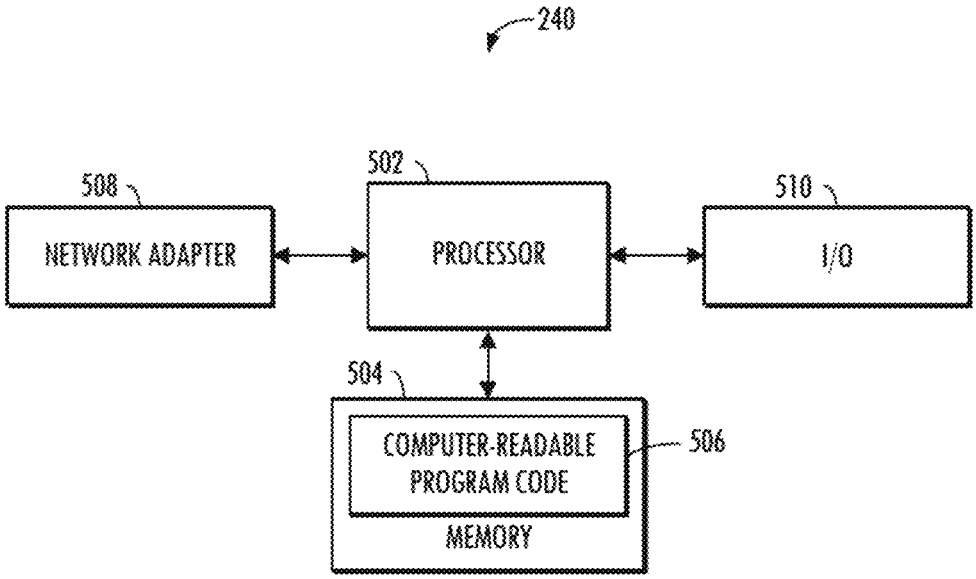

FIGS. 4A, 4B, 4C, 4D, 4E, 4F, 4G, 4H, and 4I are flowcharts illustrating various operations in a method of climate control systems, according to some example embodiments; and FIG. 5 is an illustration of control circuitry, according to an example embodiment of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration). It is understood that such terms are not used in any absolute sense.

Example embodiments of the present disclosure relate generally to a climate control system that includes an economizer heat exchanger and includes features to improve the design and efficiencies of these systems. As discussed more fully below, the climate control system may include a refrigerant circuit that routes refrigerant fluid within a refrigerant circuit. The refrigerant circuit may include a main circuit and a bypass circuit. The main circuit may direct the refrigerant fluid from a compressor to various components of the climate control system, including a condensing heat exchanger, a metering device, an evaporating heat exchanger, and an accumulator. The bypass circuit may be used to selectively direct a portion of the refrigerant fluid from a location between a condensing heat exchanger and an evaporating heat exchangers to the economizer heat exchanger. The bypass circuit may further include a bypass control valve and a bypass metering device, and the bypass control valve may be used to control the flow of the portion of the refrigerant fluid to be directed to the economizer heat exchanger. The bypass metering device may be used to lower the pressure of the portion of the refrigerant fluid before the portion of the refrigerant fluid enters the economizer heat exchanger. By lowering the pressure, the refrigerant fluid may flash to a lower pressure liquid and vapor mixture which may have a lower temperature. The lower pressure refrigerant fluid may also allow the portion of the refrigerant fluid to evaporate and absorb thermal energy at lower temperatures.

The climate control system disclosed herein may further locate the economizer heat exchanger at an accumulator, which may provide advantageous packaging designs along with thermal efficiencies. In some examples, the economizer heat exchanger is designed as a tube-in-tube heat exchanger. In some examples, the economizer heat exchanger may be in a helix shape, and in some of these examples, the helical shape is wrapped around the accumulator. These and other examples will be discussed in greater detail herein.

Figure 1:
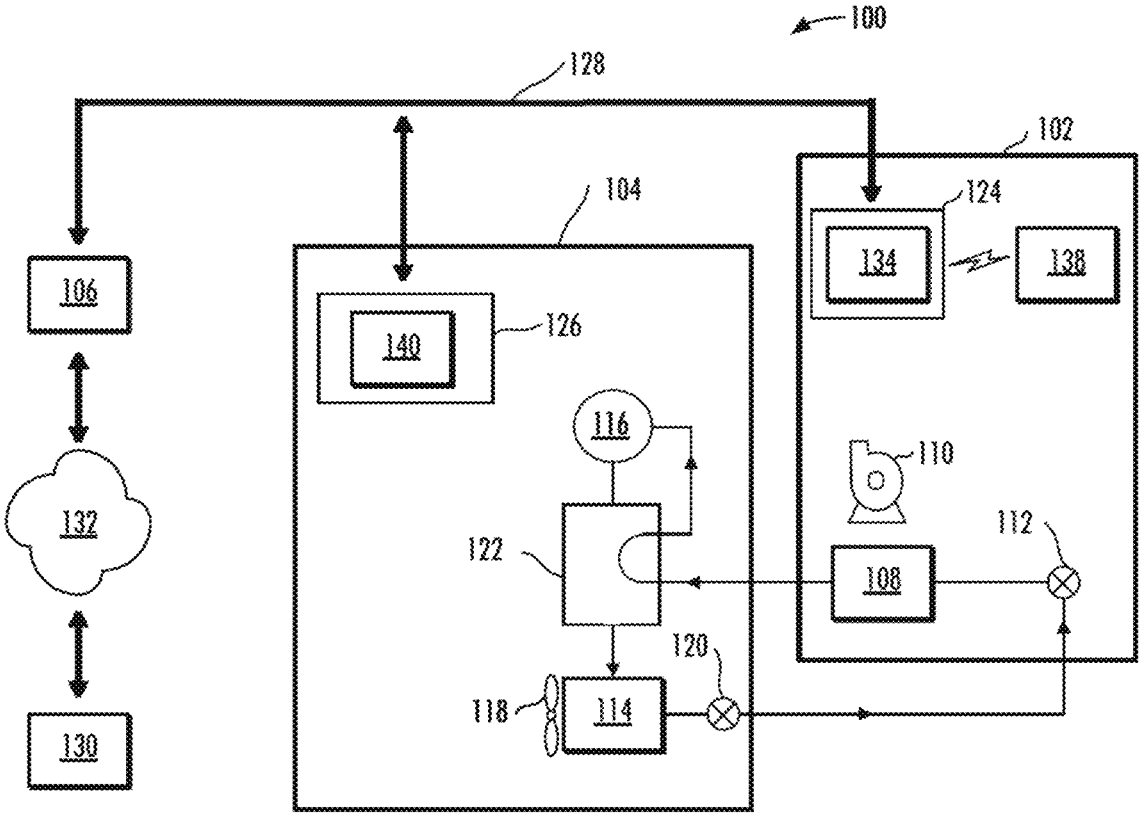
FIG. 1 is a schematic of a climate control system, according to an example embodiment of the present disclosure.

FIG. 1 shows a schematic diagram of a typical climate control system 100. In some embodiments, the climate control system 100 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The embodiments depicted in FIG. 1 is configured in a cooling mode. The climate control system 100, in some embodiments is configured as a split system heat pump system, and generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between a refrigerant carried within internal tubing of the indoor heat exchanger 108 and an airflow that may contact the indoor heat exchanger 108 but that is segregated from the refrigerant.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device.

Outdoor unit 104 generally comprises an outdoor heat exchanger 114, a compressor 116, an outdoor fan 118, an outdoor metering device 120, a switch over valve 122, and an outdoor controller 126. The outdoor heat exchanger 114 may generally be configured to promote heat transfer between a refrigerant carried within internal passages of the outdoor heat exchanger 114 and an airflow that contacts the outdoor heat exchanger 114 but is segregated from the refrigerant.

The outdoor metering device 120 may generally comprise a thermostatic expansion valve. In some examples, however, the outdoor metering device 120 may comprise an electronically-controlled motor driven EEV similar to indoor metering device 112, a capillary tube assembly, and/or any other suitable metering device.

In some examples, the switch over valve 122 may generally comprise a four-way reversing valve. The switch over valve 122 may also comprise an electrical solenoid, relay, and/or other device configured to selectively move a component of the switch over valve 122 between operational positions to alter the flow path of refrigerant through the switch over valve 122 and consequently the climate control 100. Additionally, the switch over valve 122 may also be selectively controlled by the system controller 106, an outdoor controller 126, and/or the indoor controller 124.

The system controller 106 may generally be configured to selectively communicate with the indoor controller 124 of the indoor unit 102, the outdoor controller 126 of the outdoor unit 104, and/or other components of the climate control system 100. In some embodiments, the system controller 106 may be configured to control operation of the indoor unit 102, and/or the outdoor unit 104. In some embodiments, the system controller 106 may be configured to monitor and/or communicate with a plurality of temperature sensors associated with components of the indoor unit 102, the outdoor unit 104, and/or the outdoor ambient temperature. Additionally, in some embodiments, the system controller 106 may comprise a temperature sensor and/or may further be configured to control heating and/or cooling of conditioned spaces or zones associated with the climate control system 100. In other embodiments, the system controller 106 may be configured as a thermostat for controlling the supply of conditioned air to zones associated with the climate control system 100, and in some embodiments, the thermostat includes a temperature sensor.

The system controller 106 may also generally comprise an input/output (I/O) unit (e.g., a graphical user interface, a touchscreen interface, or the like) for displaying information and for receiving user inputs. The system controller 106 may display information related to the operation of the climate control system 100 and may receive user inputs related to operation of the climate control system 100. However, the system controller 106 may further be operable to display information and receive user inputs tangentially related and/or unrelated to operation of the climate control system 100. In some embodiments, the system controller 106 may not comprise a display and may derive all information from inputs that come from remote sensors and remote configuration tools.

In some examples, the system controller 106 may be configured for selective bidirectional communication over a communication bus 128, which may utilize any type of communication network (e.g., a controller area network (CAN) messaging, etc.). In some examples, portions of the communication bus 128 may comprise a three-wire connection suitable for communicating messages between the system controller 106 and one or more of the components of the climate control system 100 configured for interfacing with the communication bus 128. Still further, the system controller 106 may be configured to selectively communicate with components of the climate control system 100 and/or any other device 130 via a communication network 132. In some examples, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116.

Figure 2A:
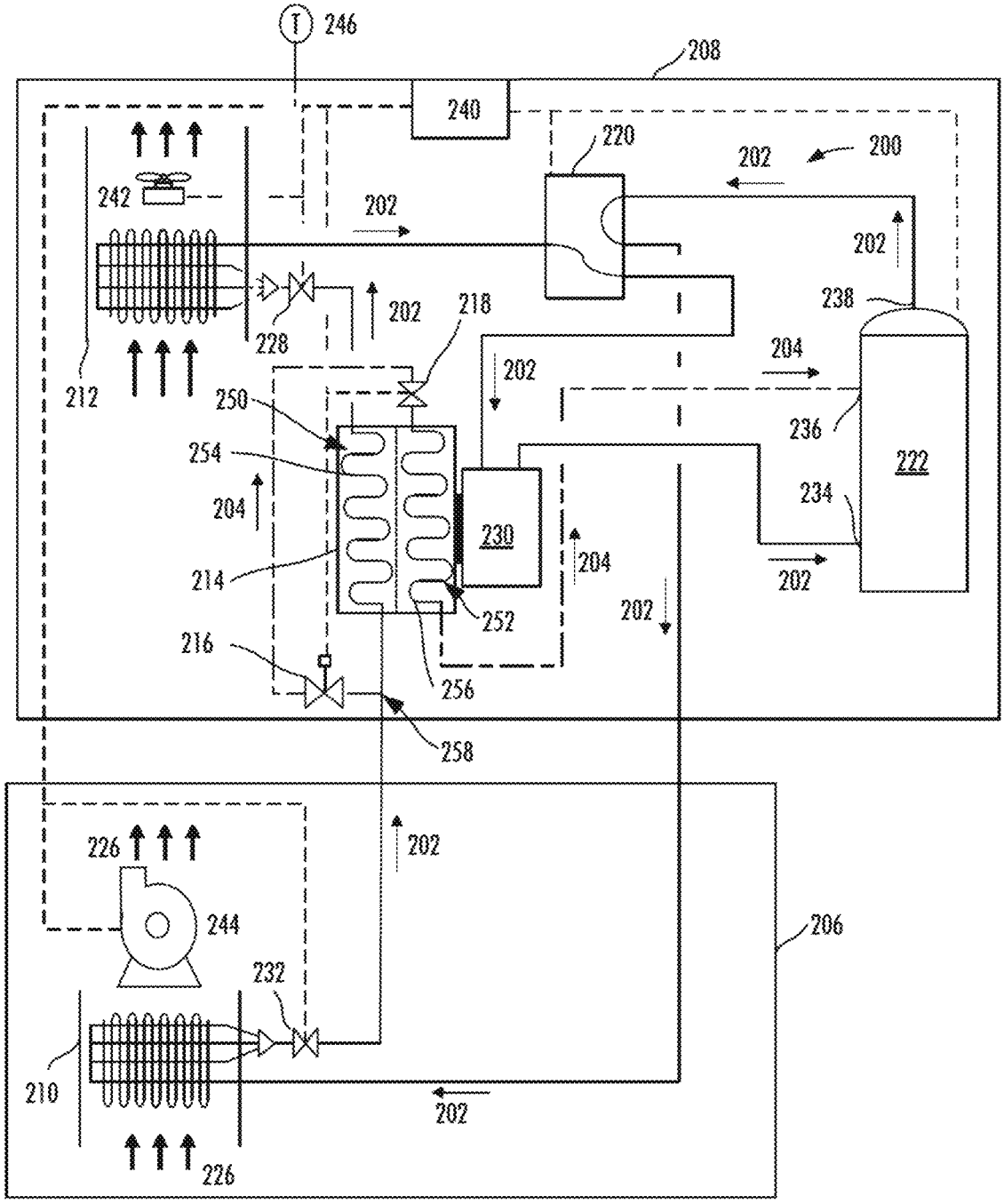
FIG. 2A is a schematic of a heating mode refrigerant cycle of a climate control system with an economizer heat exchanger, according to an example embodiment of the present disclosure.
Figure 2B:
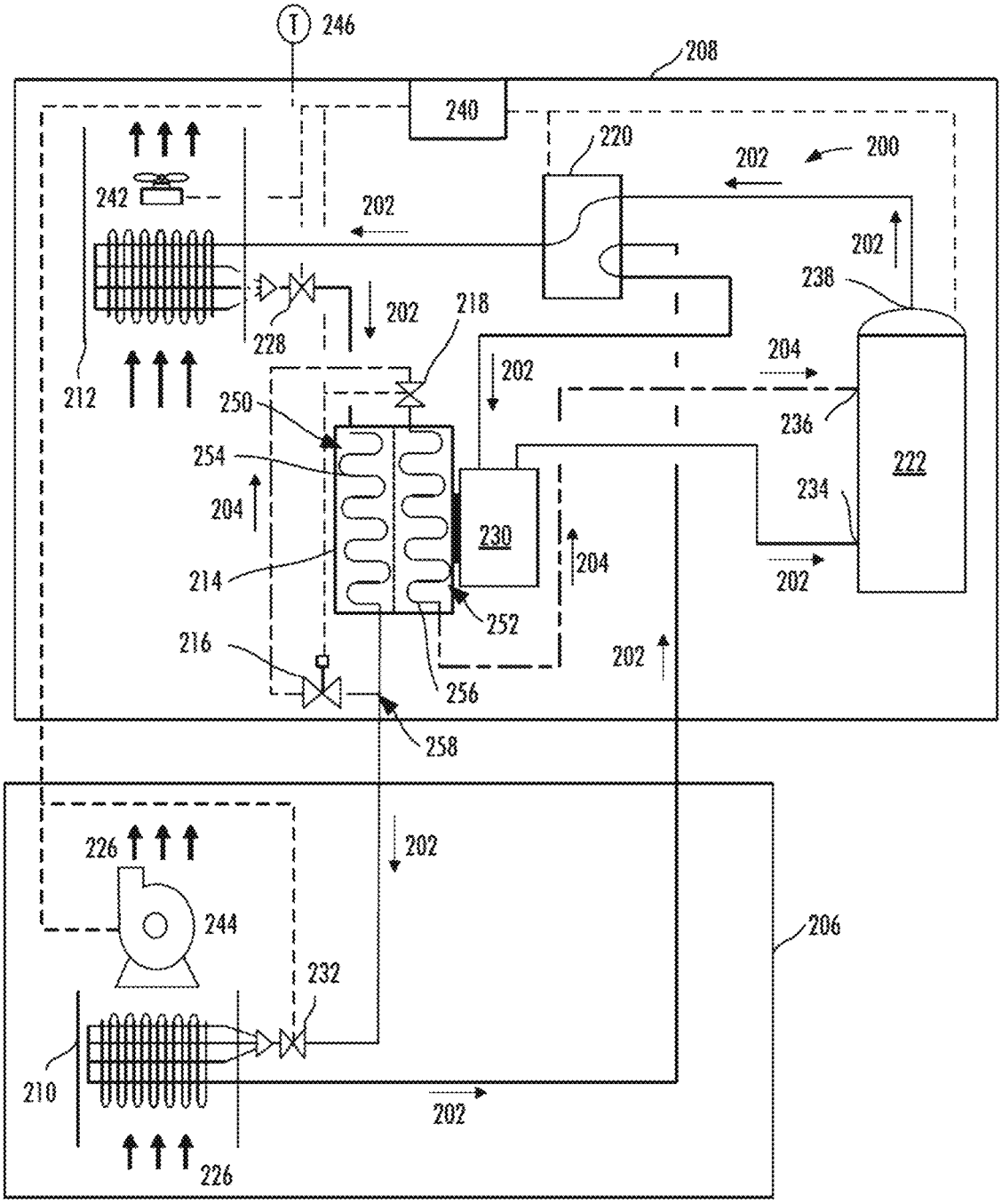
FIG. 2B is a schematic of a cooling mode refrigerant cycle of a climate control system with an economizer heat exchanger, according to an example embodiment of the present disclosure.

FIGS. 2A and 2B provide further examples of the climate control system 100 where the refrigerant circuit 200 includes both a main circuit 202 and a bypass circuit 204. FIG. 2A shows an example schematic of the climate control system operating in heating mode, and FIG. 2B shows an example schematic of the climate control system operating in cooling mode. In these illustrated examples, the climate control system includes both an indoor unit 206 and an outdoor unit 208, which may be the same or substantially similar to indoor unit 102 and outdoor unit 104. In other examples, the climate control system may be a packaged unit with the various components included within a single housing or other configurations.

In the examples depicted in FIGS. 2A and 2B, the refrigerant circuit 200 routes the refrigerant fluid within the climate control system 100. The bypass circuit 204 may selectively direct a portion of the refrigerant fluid from a location between the first and second heat exchangers, potentially an indoor heat exchanger 210 and an outdoor heat exchanger 212, to a third heat exchanger, potentially an economizer heat exchanger 214. The bypass circuit may also include a bypass control valve 216 and a bypass metering device 218. The bypass control valve may control the flow of a portion of the refrigerant fluid to be directed to the third heat exchanger, e.g., the economizer heat exchanger. The bypass metering device may lower the pressure, and potentially the temperature, of the portion of the refrigerant fluid before the portion of the refrigerant fluid enters the third heat exchanger.

In some examples, the refrigerant circuit 200 may also include a switch over valve 220, which may be the same or similar to the switch over valve 122 discussed above. In some examples, the switch over valve 220 includes a heating mode position and a cooling mode position. In these examples, the heating mode position directs the flow of refrigerant in the main circuit 202 in a heating mode circuit that directs the refrigerant fluid from the second heat exchanger 210 to the first heat exchanger 212, e.g., FIG. 2A. In the cooling mode position, the switch over valve directs the flow of refrigerant in the main circuit in a cooling mode circuit that directs the refrigerant fluid from the first heat exchanger 212 to the second heat exchanger 210, e.g. FIG. 2B.

To walk through these circuits in more detail, FIG. 2A provides an example depicted of the climate control system 100 in heating mode. In this mode, the main circuit 202 directs the refrigerant from the compressor 222 to the switch over valve 220. In heating mode, the switch over valve 220 may then direct the refrigerant fluid to the indoor heat exchanger 210. In heating mode, the refrigerant fluid may transfer thermal energy to the conditioned airflow 226 at the indoor heat exchanger, heating the conditioned air flow to potentially satisfy a heating demand for the conditioned space. In some examples, the refrigerant fluid may condense at the indoor heat exchanger in heating mode and this heat exchanger may be referred to as a condenser during heating mode.

In the example depicted in FIG. 2A, in heating mode, the refrigerant fluid is directed from the indoor heat exchanger 210 to the economizer heat exchanger 214, which in the depicted example is located in the outdoor unit 208. The refrigerant fluid flows through the economizer heat exchanger and is directed to the outdoor metering device 228. The outdoor metering device may be the same or substantially similar to the outdoor metering device 120 discussed above. The outdoor metering device may reduce the pressure, and potentially the temperature, of the refrigerant fluid prior to entering the outdoor heat exchanger 212.

In the example depicted in FIG. 2A, in heating mode, the refrigerant fluid enters the outdoor heat exchanger 212 following the outdoor metering device 228. At the outdoor heat exchanger the refrigerant fluid may exchange thermal energy with a fluid flowing through the outdoor heat exchanger, often an ambient air flow. In heating mode, the refrigerant fluid may absorb heat from this fluid flow, potentially evaporating and/or increasing in temperature. As a result, in some examples the outdoor heat exchanger may be referred to as an evaporator in heating mode. From the outdoor heat exchanger, the refrigerant fluid may be directed back to the switch over valve 220, before going to the accumulator 230 and then returning to the compressor 222.

The example depicted in FIG. 2B shows the refrigerant fluid circulating in the main circuit 202 in cooling mode. In the depicted example, the refrigerant fluid in the main circuit is circulated in largely the reverse direction. To walk through FIG. 2B, the compressor 222 directs the refrigerant fluid from the compressor to the switch over valve 220. As shown in FIG. 2B, in cooling mode, the switch over valve directs the refrigerant fluid to the outdoor heat exchanger 212. The outdoor heat exchanger may serve as a condenser in cooling mode, discharging thermal energy to an air flow through the outdoor heat exchanger.

In the example depicted in FIG. 2B, in cooling mode, the refrigerant fluid is directed from the outdoor heat exchanger 212 through an economizer heat exchanger 214. After leaving the economizer heat exchanger, the refrigerant fluid is directed to the indoor unit 206 and the indoor metering device 232. The indoor metering device may be the same or substantially similar to the indoor metering device 112 discussed above.

In the example depicted in FIG. 2B, in cooling mode, the indoor metering device 232 lowers the pressure, and potentially the temperature, associated with the refrigerant fluid before entering the indoor heat exchanger 210. At the indoor heat exchanger, the refrigerant fluid may exchange thermal energy with a conditioning airflow 226 that circulates between the climate control system 100 and a conditioned space (not shown). In cooling mode, the indoor heat exchanger directs thermal energy from the conditioning air flow into the refrigerant fluid, lowering the temperature of the conditioned air flow. In some examples, this thermal exchange in cooling mode may cause the refrigerant fluid to evaporate and it may also increase the temperature of the refrigerant fluid. Thus, in cooling mode, the indoor heat exchanger may sometimes be referred to as the evaporator.

In the example depicted in FIG. 2B, in cooling mode, the refrigerant fluid is directed from the indoor heat exchanger 210 back to the switch over valve 220. The switch over valve may direct the refrigerant fluid to an accumulator 230 before being returned to the compressor 222. Refrigerant fluid may be stored at the accumulator, and in some examples, the accumulator is used to vary the amount of refrigerant circulating within the climate control system. The accumulator may also be used to remove any refrigerant fluid in a liquid state from the refrigerant circuit before the refrigerant fluid enters the compressor to avoid potentially damaging the compressor.

The examples depicted in FIGS. 2A and 2B further include a bypass circuit 204. As shown in the depicted examples, the bypass circuit may direct a portion of the refrigerant fluid from the main circuit 202 to the economizer heat exchanger 214. In these examples, the bypass circuit couples to the main circuit between the indoor heat exchanger 210 and the outdoor heat exchanger 212, e.g., between a first and a second heat exchanger in the main circuit. At the economizer heat exchanger the refrigerant fluid in the bypass circuit may exchange thermal energy with the refrigerant fluid in the main circuit that also passes through the economizer heat exchanger. The bypass circuit then directs the refrigerant fluid from the economizer heat exchanger back to the compressor 222, but typically via the bypass circuit separate from the main circuit.

In the examples depicted in FIGS. 2A and 2B the economizer heat exchanger 214 includes two separate refrigerant flow channels, a first channel 250 and a second channel 252. The first channel may receive a first refrigerant fluid flow 254 and the second channel may receive a second refrigerant fluid flow 256. In some examples, the economizer heat exchanger exchanges thermal energy between the first and second refrigerant fluid flows as the fluid travels through the first and second channels. In the depicted example, the first refrigerant fluid flow is the portion of the refrigerant fluid in the main circuit 202. As shown, the portion of the refrigerant fluid in the main circuit 202 between the indoor heat exchanger 210 and the outdoor heat exchanger 212 is directed into the first channel of the economizer heat exchanger. In the depicted example, the second refrigerant fluid flow is the portion of the refrigerant fluid in bypass circuit 204. As shown, the portion of the refrigerant fluid in the bypass circuit branches off from the main circuit, and in the depicted example, this bypass circuit branches off at branch point 258 between the indoor heat exchanger 210 and the outdoor heat exchanger 212. In the depicted example, branch point 258 is between the indoor heat exchanger and the economizer heat exchangers. In other examples, the bypass circuit may couple to the main circuit at other locations, e.g., between the outdoor heat exchanger and the economizer heat exchanger. Turning back to FIGS. 2A and 2B, in these depicted examples, the portion of the refrigerant fluid in the bypass circuit is directed into the second channel of the economizer heat exchanger. As discussed below, in some examples, the portion of the refrigerant fluid in the bypass circuit goes through additional components prior to entering the second channel to facilitate thermal transfer between the refrigerant fluid in the main circuit flowing through the first channel as the first refrigerant fluid flow, and the refrigerant fluid in the bypass circuit flowing through the second channel as the second refrigerant fluid flow.

In the depicted example, compressor 222 is a vapor injection compressor. In this example, the compressor has an inlet 234, an outlet 238, and an intermediate port 236. The intermediate port may allow refrigerant fluid to be injected into the compressor at an intermediate location, potentially between compression stages. In the depicted examples, the refrigerant fluid in the bypass circuit is directed into the intermediate injection port of the vapor injection compressor. The refrigerant fluid in the main circuit 202 is received by the compressor at the inlet, and refrigerant fluid from both the main circuit and the bypass circuit exits the compressor via the outlet. Other compressors or configurations may be used with the disclosure examples herein.

As shown in the depicted in examples in FIGS. 2A and 2B, the bypass circuit 204 may include various valves and devices to control the flow of the refrigerant fluid within the bypass circuit. For example, a bypass control valve 216 may be included in the bypass circuit. The bypass control valve may be used to control the flow of refrigerant fluid into the bypass circuit. In some examples, the bypass control valve may control the flow of fluid in a binary fashion, e.g., either allow refrigerant fluid to enter the bypass circuit or to close the bypass circuit and stop any flow of refrigerant fluid into the bypass circuit. In other examples, the bypass control valve may modulate the flow of refrigerant to adjust the flow rate of the refrigerant fluid through the bypass circuit. In some examples, the bypass control valve is a solenoid valve, and in other examples, the control valve may be a modulating valve.

In some examples, the bypass circuit 204 may also include a bypass metering device 218. This bypass metering device may be used to reduce the pressure and temperature of the refrigerant fluid within the bypass circuit prior to entering the economizer heat exchanger 214. In some examples, lowering the pressure or temperature of the refrigerant fluid at that point in the bypass circuit allows for thermal exchanger between the fluid flows within the economizer heat exchanger. For example, lowering the temperature of the refrigerant fluid in the bypass circuit portion of the economizer heat exchanger prior to that fluid entering the economizer heat exchanger may allow for the temperature in that fluid to be lower than the refrigerant fluid in the main circuit portion of the economizer heat exchanger. This temperature differential may allow thermal energy to flow from the refrigerant fluid in the main circuit portion to the refrigerant fluid in the bypass circuit portion. In some examples, the bypass metering device may be the same or substantially similar to the metering devices discussed above, e.g., the indoor metering device 112 or the outdoor metering device 120. In some examples, the bypass metering device is controlled based on the desired thermal exchange between the refrigerant fluid in the bypass circuit and the refrigerant fluid in the main circuit.

In some examples, the economizer heat exchanger 214 may receive refrigerant fluid from both the main circuit 202 and the bypass circuit 204. In these examples, the refrigerant fluid may allow for the exchange of thermal energy between these fluid flows. As shown in the depicted example, the economizer heat exchanger may be arranged in a counter flow configuration when the climate control system 100 operates in heating mode as shown in FIG. 2A, and in a concurrent flow configuration when the climate control system operates in a cooling mode as shown in FIG. 2B. In some examples, this arrangement is reversed, e.g., the economizer heat exchanger is arranged for concurrent flow in cooling mode and counter flow in heating mode. Other more complete designs may be utilized, e.g., designs that are counter or concurrent flow in both conditioning mode.

In the examples depicted in FIGS. 2A and 2B, the economizer heat exchanger 214 is coupled to the accumulator 230. In some examples, this may be desirable because it allows for packaging advantages, and in some examples, it provides for advantageous thermal exchange between the fluids within the economizer heat exchanger and the accumulator. For example, the refrigerant fluid in the main circuit 202 routed through the heat exchanger may exchange thermal energy with the accumulator. In some examples, while the switch over valve directs the refrigerant fluid in the main circuit in the heating mode circuit, the thermal energy may be directed from the refrigerant fluid in the main circuit to the accumulator. Similarly, in cooling mode, while the switch over valve directs the refrigerant fluid in the main circuit in the cooling mode circuit, the thermal energy may be directed in the same manner, e.g., from the refrigerant fluid in the main circuit to the accumulator. In other configurations the thermal energy may be directed in different ways, and in some examples, the refrigerant fluid in the bypass circuit is in thermal communication with the accumulator to exchange thermal energy.

Figure 3D:
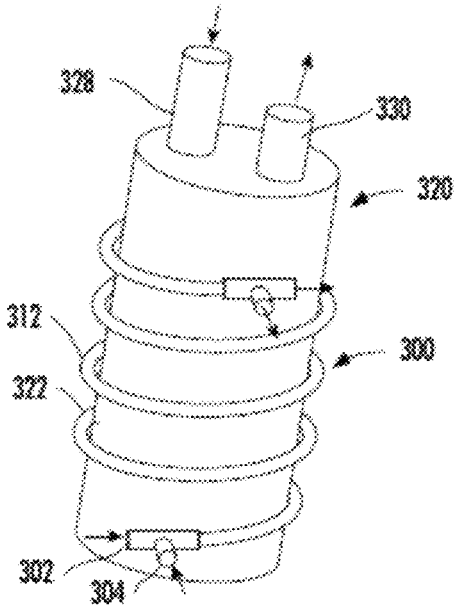
FIG. 3D is an illustration of an economizer heat exchanger and an accumulator, according to an example embodiment of the present disclosure.

FIGS. 3A-F show example illustrations of the economizer heat exchanger 300, which may be the same or substantially similar to the economizer heat exchanger 214 discussed above. FIG. 3A shows an example of the economizer heat exchanger, and in the depicted example, the heat exchanger is a tube-in-tube heat exchanger. The depicted heat exchanger includes an inner fluid channel 302 and an outer fluid channel 304. In some examples, the first fluid channel 250 may be the outer fluid channel 304, and the second fluid channel 252 may be the inner fluid channel 302. Other configurations may also be utilized. In the examples depicted in FIGS. 3A-F, the inner fluid channel receives and directs the portion of the refrigerant fluid in the bypass circuit 204 through the economizer heat exchanger, and the outer fluid channel receives and directs the refrigerant fluid in the main circuit 202 through the economizer heat exchanger. The depicted example further shows the heat exchanger as a concurrent flow design, where both fluids are directed in the same direction relative to each other. This example also shows the heat exchanger in a helical shape and design. This design includes an inner circumference surface 306 and an outer circumference surface 308.

In some examples, the economizer heat exchanger 300 may be any conventional heat exchanger designed to exchanger thermal energy between fluid flows. In other examples, the heat exchanger may be a tube-in-tube design with a different configuration. In some examples, the flows may be configured in a counter flow arrangement.

In some examples, the inner and outer channels (302 and 304) may be sized to optimize the heat exchange between the fluids flowing within these channels, and potentially optimize heat transfer with the accumulator. For example, the tube-in-tube heat exchanger may have a symmetrical design (as shown in FIG. 3B) or an asymmetrical design (as shown in FIG. 3C). The symmetrical design may align the inner channel and the outer channels along substantially the same axis. The asymmetrical design may align these channels along different axes. In some examples, the asymmetrical design allows for a greater flow of fluid in the outer fluid channel along the inner circumference 306 of the heat exchanger, and as a result, it may allow for greater thermal exchanger between the fluid in the outer fluid channel and devices located within the inner circumference, e.g., the accumulator 230. Other designs and configurations may be used.

In other examples, a different design for the economizer heat exchanger 300 is utilized. For example, the economizer heat exchanger is a brazed plate heat exchanger. Other examples may use a plate and fin design or a shell and tube heat exchanger design. Other heat exchanger designs may also be used.

In some examples, the economizer heat exchanger 300 includes insulation 310 as shown in FIGS. 3B and 3C. In the depicted examples the insulation fully surrounds the outer wall 312 of the economizer heat exchanger. In other examples, the insulation may only partially surround the outer surface. For example, the heat exchanger may be coupled to the accumulator 230 and the insulation is only provided on a portion of the outer surface. In these examples, the insulation may be arranged to maximize heat transfer between the accumulator and the economizer heat exchanger. As a result, the insulation may only be provided on the outer surface of the portion facing away from the accumulator, potentially surface 308. In some examples, the insulation may only be provided on the outer surface not coupled to and/or proximate with the accumulator. Other configurations may also be utilized.

Figure 3E:
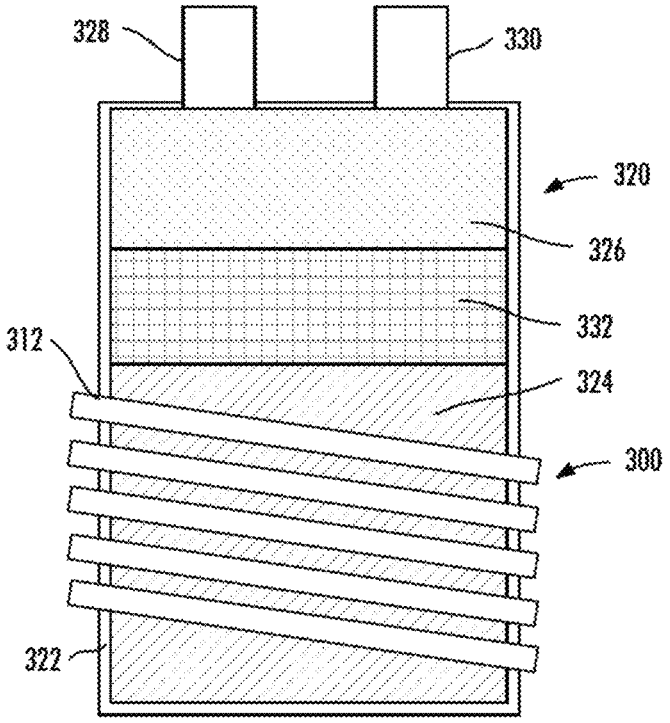
FIG. 3E is a diagram of an economizer heat exchanger and an accumulator, according to an example embodiment of the present disclosure.

FIGS. 3D and 3E show example illustrations of the economizer heat exchanger 300 coupled to an accumulator 320, which in some examples, may be the same or substantially similar to accumulator 230. FIG. 3D shows an example illustration of the heat exchanger engaged with the accumulator, and FIG. 3E shows an example diagram of these components coupled together. In both of these examples, the heat exchanger is a helical shape and wrapped around the accumulator. As shown in FIGS. 3D and 3E, in some examples, the outer wall 312 of the economizer heat exchanger abuts an outer wall 322 of the accumulator 320. In these examples, the outer wall may be in contact with the accumulator. This may include routing a portion of the outer wall to be in contact with the accumulator. In some examples, an outer wall of the economizer, or a portion of the outer wall, is attached to the accumulator. In some examples, the outer wall is metallurgically attached to the accumulator, e.g., through welding or other techniques. In some examples, the outer wall is flattened (not shown) at some or all of the portions where the outer wall contacts the accumulator.

Figure 3F:
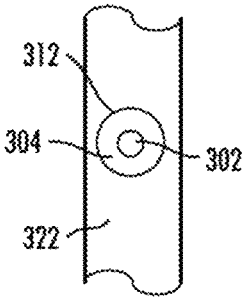
FIG. 3F is an illustration of a portion of an economizer heat exchanger and a wall of an accumulator, according to an example embodiment of the present disclosure.

In some examples, a portion of the economizer heat exchanger is routed within a wall of the accumulator. FIG. 3F shows an example cross section illustration of these examples where a portion of the heat exchanger 300 is routed within a wall 322 of the accumulator. In the depicted example, heat exchanger 300 is a tube-in-tube design and a portion of the heat exchanger is routed through wall 322. This design allows the outer wall 312 of the economizer heat exchanger to abut the wall 322 of the accumulator on multiple sides and locations. In some examples, the heat exchanger is coupled to the accumulator through other mechanisms, e.g., brackets, fasteners, etc.

FIG. 3E shown an example diagram of the economizer heat exchanger 300 coupled to the accumulator 320. In the depicted example, the accumulator includes a lower portion 324 and an upper portion 326. In these examples, the lower portion is the portion of the accumulator that houses a liquid refrigerant fluid, and the upper portion being the portion of the accumulator that houses a gas refrigerant fluid. For example, as discussed above, the accumulator may be used in the climate control system 100 to store refrigerant fluid, potentially controlling the volume of refrigerant circulating within the circuit, ensuring only gas refrigerant enters the compressor, or other purposes. As part of this process, refrigerant fluid entering the accumulator at inlet 328 may be in different physical states, e.g., liquid, gas, mixture of liquid and gas, etc. The refrigerant leaving the accumulator at the outlet 330 may be in any state as well, but often will be in a gas state. The refrigerant fluid in the accumulator, as a result, may be in various different states. Typically, the refrigerant fluid may include some refrigerant fluid in a liquid state and some refrigerant fluid in a gas state. In the accumulator, the liquid may settle to the bottom due to density, with the gas potentially rising to the top. The level at which the liquid settles may vary during the operation of the climate control system based on various factors, e.g., conditioning mode, load, etc., and thus the depicted example includes an intermediate portion 332 indicating the portion of the accumulator that may at various times house either liquid or gas refrigerant fluid. As further shown in this depicted example, the lower portion 324 is the portion that will typically house liquid refrigerant. In some examples, this level is based on the standard liquid level in an accumulator during normal or average heating mode conditions, or in other examples, it is the level based on peak heating mode conditions. In still other examples, it is the standard liquid level in the accumulator during normal or average cooling mode conditions, or in other examples, it is the level based on peak cooling mode conditions. The upper portion 326 may be similarly defined based on the gas level. For example, this portion may be the upper portion of the accumulator starting where the gas level is anticipated or determined based on normal, average, peak heating or cooling mode conditions. In the depicted example, the economizer heat exchanger 300 is located at and in thermal communication with the lower portion 324 of the accumulator 320.

Returning to FIGS. 2A and 2B, the depicted examples, also include control circuitry 240. In some examples the control circuit includes some or all of the system controller 106, the indoor controller 124, and the outdoor controller 126. In the depicted example, the control circuitry is operably coupled to the control valve 216, the bypass metering device 218, the compressor 222, the switch over valve 220, the outdoor fan 242, and the indoor fan 244. In some examples, the control circuitry is coupled to more or less components of the climate control system 100. In the examples depicted in FIGS. 2A and 2B, the control circuitry 240 is coupled to sensor 246, and in this example, the sensor is a temperature sensor which provides the control circuitry signals indicative of the temperature of the outdoor environment. In some examples, the control circuitry is further coupled to one or more additional sensors. This sensor may be a temperature sensor, humidity sensor, pressure sensor, or other sensor. These sensors may be located at various points on the refrigerant circuit 200 or other locations, e.g., conditions space, outdoor environment, etc.

In some examples, the control circuitry 240 is operably coupled to the switch over valve 220 and the bypass control valve 230. In these examples, the control circuitry may be configured to locate the switch over valve in the heating mode position when a heating mode call is received and in the cooling mode position when a cooling mode call is received. In these examples, the control circuitry may control the switch over valve based on the conditioning mode requested. For example, the control circuitry may control the switch over valve to be located in a heating mode position when a heating call is received, which may direct the refrigerant fluid in the main circuit 202 in the heating mode configuration shown in FIG. 2A. The control circuitry may also control the switch over valve to be located in a cooling mode position when a cooling call is received, which may direct the refrigerant fluid in the main circuit in the cooling mode configuration shown in FIG. 2B.

In some examples, the control circuitry 240 includes control circuitry that opens and/or closes the bypass control valve 216. Opening the bypass control valve may allow a portion of the refrigerant fluid to flow into the bypass circuit 204. Closing the bypass control valve may stop the flow of refrigerant fluid through the bypass circuit. In some examples, the control circuitry may modulate the control valve between a fully open position and a fully closed positions. In these examples, the control valve may be controlled to allow a selected flow rate through the bypass circuit. In some examples, the control circuitry opens the bypass control valve to allow the flow of the portion of the refrigerant fluid in the bypass circuit while the heating mode call is received. In some examples, the control circuitry closes the bypass control valve to stop the flow of the portion of the refrigerant fluid from flowing into the bypass circuit while the cooling mode call is received. Other configurations may also be utilized.

In some examples, the control circuitry 240 may also include control circuitry that receives an indication of an outdoor ambient temperature. In these examples, the control circuitry may be coupled to a temperature sensor, for example sensor 246, which may provide a signal indicative of the outdoor ambient temperature. In other examples, the control circuitry may receive this information from a remote source, e.g., the internet, remote devices, user input, etc.

In some examples, the control circuitry 240 may also include control circuitry that closes the bypass control valve 216 to stop the portion of the refrigerant fluid from flowing into the bypass circuit 204 while the heating mode call is received and the outdoor ambient temperature is above a threshold temperature. In some examples, the control circuitry may open the bypass control valve when the heating mode call is received and the outdoor ambient temperature is below a threshold temperature. In these examples, the bypass control valve may be controlled to optimize the heat transfer with the refrigerant circuit based on the outdoor temperature. For example, the economizer heat exchanger 214 may only provide energy savings when the outdoor temperature is below a set temperature value, e.g., 30° F. As a result, the control circuitry may control the bypass control valve based on this temperature, closing the control valve to cut off the flow of refrigerant when the outdoor ambient temperature is above the set temperature value and/or opening the control valve to allow the refrigerant fluid to flow when the outdoor ambient temperature is below the set temperature value. In some examples, the bypass control valve is controlled based on compressor speed in addition to temperature. In these examples, the bypass control valve may only open when the outdoor temperature is below the set temperature value and the compressor speed is above a threshold speed value, and conversely, the bypass control valve may close when the compressor speed is below the threshold speed value.

FIGS. 4A, 4B, 4C, 4D, 4E, 4F, 4G, 4H, and 4I are flowcharts illustrating various steps in a method 400 of controlling the refrigerant fluid flow in the climate control system 100. The method may include circulating the refrigerant fluid in a refrigerant circuit 200 of the climate control system using a compressor 222, as shown in block 402 of FIG. 4A. The refrigerant circuit may include a main circuit 202 and a bypass circuit 204. The method may also include directing the refrigerant fluid in the main circuit from the compressor 222 to a first heat exchanger 212, a metering device 232, a second heat exchanger 210, and an accumulator 320, as shown in block 404. The method may further include selectively directing a portion of the refrigerant fluid through the bypass circuit from a location between the first and second heat exchangers to a third heat exchanger 300 using a bypass control valve 216, as shown in block 406. The third heat exchanger may be located proximate an accumulator 320. The method may further include lowering the pressure of the portion of the refrigerant fluid before the portion of the refrigerant fluid enters the third heat exchanger using a bypass metering device 218, as shown in block 408. The method may also include exchanging thermal energy between the portion of the refrigerant fluid in the bypass circuit and the refrigerant fluid in the main circuit at the third heat exchanger while the portion of the refrigerant fluid is circulating in the bypass circuit, as shown in block 410.

In some examples, directing the refrigerant in the main circuit 202 further includes directing the refrigerant fluid in one of either a heating mode circuit or a cooling mode circuit using a switch over valve 220, as shown in block 412 of FIG. 4B. In these examples, the heating mode circuit may include directing the refrigerant fluid from the second heat exchanger 210 to the first heat exchanger 212, and the cooling mode circuit may include directing the refrigerant fluid from the first heat exchanger 212 to the second heat exchanger 210. In some examples, selectively directing the portion of the refrigerant fluid in the bypass circuit 204 includes opening the bypass control valve 216 to allow the portion of the refrigerant fluid to flow in the bypass circuit while the switch over valve directs the refrigerant fluid in the main circuit in the heating mode circuit, as shown in block 414. In these examples, the method 400 may also include exchanging thermal energy from the refrigerant fluid in the main circuit to the accumulator 320 while the switch over valve directs the refrigerant fluid in the main circuit in the heating mode circuit, as shown in block 416.

In some examples, the method 400 further includes receiving an indication of an outdoor ambient temperature, as shown in block 418 of FIG. 4C. The method may also include stopping the portion of the refrigerant fluid from flowing in the bypass circuit 204 by closing the bypass control valve 216 while a heating mode call is received and the outdoor ambient temperature is above a threshold temperature, as shown in block 420.

In some examples, directing the refrigerant in the main circuit 202 further includes directing the refrigerant fluid in one of either a heating mode circuit or a cooling mode circuit using a switch over valve 220, as shown in block 422 of FIG. 4D. In these examples, the heating mode circuit may include directing the refrigerant fluid from the second heat exchanger 210 to the first heat exchanger 212, and the cooling mode circuit may include directing the refrigerant fluid from the first heat exchanger 212 to the second heat exchanger 210. In some examples, selectively directing the portion of the refrigerant fluid in the bypass circuit 204 further includes stopping the portion of the refrigerant fluid from flowing into the bypass circuit by closing the bypass circuit while the switch over valve directs the refrigerant fluid in the main circuit in the cooling mode circuit, as shown in block 424. In these examples, the method 400 may further include exchanging thermal energy from the refrigerant fluid in the main circuit to the accumulator 320 while the switch over valve directs the refrigerant fluid in the main circuit in the cooling mode circuit, as shown in block 426.

In some examples, the third heat exchanger 300 is a tube-in-tube heat exchanger that includes an inner fluid channel 302 and an outer fluid channel 304. In these examples, the method 400 may further include directing the portion of the refrigerant fluid in the bypass circuit 204 through the inner fluid channel of the third heat exchanger, as shown in block 428 of FIG. 4E. In some examples, the method may also include directing the refrigerant fluid in the main circuit 202 through the outer fluid channel of the third heat exchanger, as shown in block 430.

In some examples, the method further includes directing the refrigerant fluid in the main circuit 202 through an outer fluid channel 304 of the third heat exchanger 300, the outer fluid channel including an outer wall 310 of the third heat exchanger that abuts an outer wall 322 of the accumulator 320, as shown in block 432 of FIG. 4F. In some examples, the method further includes directing the refrigerant fluid in the main circuit through an outer fluid channel of the third heat exchanger, the outer fluid channel including a portion routed within a wall of the accumulator, as shown in block 434 of FIG. 4G.

In some examples, the accumulator includes a lower portion 324 and an upper portion 326, the lower portion being the portion of the accumulator 320 may house a liquid refrigerant fluid, the upper portion being the portion of the accumulator that houses a gas refrigerant fluid. In these examples, exchanging thermal energy between the refrigerant fluid in the main circuit and the accumulator while the refrigerant fluid is circulating in the main circuit further includes exchanging thermal energy between the third heat exchanger and the lower portion of the accumulator, as shown in block 436 of FIG. 4H.

In some examples, the compressor 222 is a vapor injection compressor. In these examples, selectively directing the portion of the refrigerant fluid through the bypass circuit 204 further includes directing the portion of the refrigerant fluid to an intermediate injection 236 port of the vapor injection compressor, as shown in block 438 of FIG. 4I.

FIG. 5 illustrates the control circuitry 240 according to some example embodiments of the present disclosure. As discussed above, in some examples the control circuit includes some or all of the system controller 106, the indoor controller 124, and the outdoor controller 126. In some examples, the control circuitry may include one or more of each of a number of components such as, for example, a processor 502 connected to a memory 504. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 502 may be a number of processors, a multi-core processor or some other type of processor, depending on the particular embodiment.

The processor 502 may be configured to execute computer programs such as computer-readable program code 506, which may be stored onboard the processor or otherwise stored in the memory 504. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 504 is generally any piece of computer hardware capable of storing information such as, for example, data, computer-readable program code 506 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 502, causes the control circuitry 240 to perform various operations as described herein, some of which may in turn cause the HVAC system to perform various operations.

In addition to the memory 504, the processor 502 may also be connected to one or more peripherals such as a network adapter 508, one or more input/output (I/O) devices 510 or the like. The network adapter is a hardware component configured to connect the control circuitry 240 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A climate control system comprising: a refrigerant circuit configured to route a refrigerant fluid within the climate control system, the refrigerant circuit including a main circuit and a bypass circuit; the main circuit configured to direct the refrigerant fluid from a compressor to a first heat exchanger, a metering device, a second heat exchanger, and an accumulator; the bypass circuit configured to selectively direct a portion of the refrigerant fluid from a location between the first and second heat exchangers to a third heat exchanger, the bypass circuit including a bypass control valve and a bypass metering device, the bypass control valve configured to control the flow of the portion of the refrigerant fluid to be directed to the third heat exchanger, the bypass metering device configured to lower the pressure of the portion of the refrigerant fluid before the portion of the refrigerant fluid enters the third heat exchanger; and the third heat exchanger located at the accumulator and configured to exchange thermal energy between the portion of the refrigerant fluid and the refrigerant fluid in the main circuit while the portion of the refrigerant fluid is flowing in the bypass circuit.

Clause 2. The climate control system in any of the preceding clauses, further comprising: a switch over valve that includes a heating mode position and a cooling mode position, the heating mode position configured to direct the flow of refrigerant in the main circuit in a heating mode circuit that directs the refrigerant fluid from the second heat exchanger to the first heat exchanger, the cooling mode position configured to direct the flow of refrigerant in the main circuit in a cooling mode circuit that directs the refrigerant fluid from the first heat exchanger to the second heat exchanger; and control circuitry operably coupled to the switch over valve and the bypass control valve, the control circuitry configured to: locate the switch over valve in the heating mode position when a heating mode call is received and in the cooling mode position when a cooling mode call is received; open the bypass control valve to flow the portion of the refrigerant fluid in the bypass circuit while the heating mode call is received; and close the bypass control valve to stop the flow of the portion of the refrigerant fluid from flowing into the bypass circuit while the cooling mode call is received.

Clause 3. The climate control system in any of the preceding clauses, wherein the control circuitry is further configured to: receive an indication of an outdoor ambient temperature; and close the bypass control valve to stop the portion of the refrigerant fluid from flowing into the bypass circuit while the heating mode call is received and the outdoor ambient temperature is above a threshold temperature.

Clause 4. The climate control system in any of the preceding clauses, wherein the third heat exchanger is a tube-in-tube heat exchanger that includes an inner fluid channel and an outer fluid channel, the inner fluid channel directing the portion of the refrigerant fluid in the bypass circuit through the third heat exchanger, and the outer fluid channel directing the refrigerant fluid in the main circuit through the third heat exchanger.

Clause 5. The climate control system in any of the preceding clauses, wherein the third heat exchanger is insulated.

Clause 6. The climate control system in any of the preceding clauses, wherein the third heat exchanger is a helical shape and wrapped around the accumulator.

Clause 7. The climate control system in any of the preceding clauses, wherein the third heat exchanger is coupled to the accumulator.

Clause 8. The climate control system in any of the preceding clauses, wherein an outer wall of the third heat exchanger abuts an outer wall of the accumulator.

Clause 9. The climate control system in any of the preceding clauses, wherein a portion of the third heat exchanger is routed within a wall of the accumulator.

Clause 10. The climate control system in any of the preceding clauses, wherein the accumulator includes a lower portion and an upper portion, the lower portion being the portion of the accumulator that houses a liquid refrigerant fluid, the upper portion being the portion of the accumulator that houses a gas refrigerant fluid, wherein the third heat exchanger is located at and in thermal communication with the lower portion of the accumulator.

Clause 11. The climate control system in any of the preceding clauses, wherein the compressor is a vapor injection compressor, and the bypass circuit directs the portion of the refrigerant fluid to an intermediate injection port of the vapor injection compressor after having passed through the economizer heat exchanger.

Clause 12. The climate control system in any of the preceding clauses, wherein the bypass control valve and the bypass metering device are the same valve.

Clause 13. A method of controlling refrigerant fluid flow in a climate control system, the method comprising: circulating a refrigerant fluid in a refrigerant circuit of the climate control system using a compressor, the refrigerant circuit including a main circuit and a bypass circuit; directing the refrigerant fluid in the main circuit from the compressor to a first heat exchanger, a metering device, a second heat exchanger, and an accumulator; selectively directing a portion of the refrigerant fluid through the bypass circuit from a location between the first and second heat exchangers to a third heat exchanger using a bypass control valve, the third heat exchanger located proximate the accumulator; lowering the pressure of the portion of the refrigerant fluid before the portion of the refrigerant fluid enters the third heat exchanger using a bypass metering device; and exchanging thermal energy between the portion of the refrigerant fluid and the refrigerant fluid in the main circuit at the third heat exchanger while the portion of the refrigerant fluid is circulating in the bypass circuit.

Clause 14. The method in any of the preceding clauses, wherein directing the refrigerant in the main circuit further includes directing the refrigerant fluid in one of either a heating mode circuit or a cooling mode circuit using a switch over valve, the heating mode circuit directing the refrigerant fluid from the second heat exchanger to the first heat exchanger, and the cooling mode circuit directing the refrigerant fluid from the first heat exchanger to the second heat exchanger, wherein selectively directing the portion of the refrigerant fluid in the bypass circuit includes opening the bypass control valve to allow the portion of the refrigerant fluid to flow in the bypass circuit while the switch over valve directs the refrigerant fluid in the main circuit in the heating mode circuit; and the method further comprising: exchanging thermal energy from the refrigerant fluid in the main circuit to the accumulator while the switch over valve directs the refrigerant fluid in the main circuit in the heating mode circuit.

Clause 15. The method in any of the preceding clauses, further comprising: receiving an indication of an outdoor ambient temperature; and stopping the portion of the refrigerant fluid from flowing in the bypass circuit by closing the bypass control valve while a heating mode call is received and the outdoor ambient temperature is above a threshold temperature.

Clause 16. The method in any of the preceding clauses, wherein directing the refrigerant in the main circuit further includes directing the refrigerant fluid in one of either a heating mode circuit or a cooling mode circuit using a switch over valve, the heating mode circuit directing the refrigerant fluid from the second heat exchanger to the first heat exchanger, and the cooling mode circuit directing the refrigerant fluid from the first heat exchanger to the second heat exchanger, wherein selectively directing the portion of the refrigerant fluid in the bypass circuit further includes stopping the portion of the refrigerant fluid from flowing into the bypass circuit by closing the bypass circuit while the switch over valve directs the refrigerant fluid in the main circuit in the cooling mode circuit; and the method further comprising: exchanging thermal energy from the refrigerant fluid in the main circuit to the accumulator while the switch over valve directs the refrigerant fluid in the main circuit in the cooling mode circuit.

Clause 17. The method in any of the preceding clauses, wherein the third heat exchanger is a tube-in-tube heat exchanger that includes an inner fluid channel and an outer fluid channel, and the method further comprises: directing the portion of the refrigerant fluid in the bypass circuit through the inner fluid channel of the economizer heat exchanger; and directing the refrigerant fluid in the main circuit through the outer fluid channel of the third heat exchanger.

Clause 18. The method in any of the preceding clauses, further comprising directing the refrigerant fluid in the main circuit through an outer fluid channel of the third heat exchanger, the outer fluid channel including an outer wall of the third heat exchanger that abuts an outer wall of the accumulator.

Clause 19. The method in any of the preceding clauses, further comprising directing the refrigerant fluid in the main circuit through an outer fluid channel of the third heat exchanger, the outer fluid channel including a portion routed within a wall of the accumulator.

Clause 20. The method in any of the preceding clauses, wherein the accumulator includes a lower portion and an upper portion, the lower portion being the portion of the accumulator that houses a liquid refrigerant fluid, the upper portion being the portion of the accumulator that houses a gas refrigerant fluid, wherein exchanging thermal energy between the refrigerant fluid in the main circuit and the accumulator while the refrigerant fluid is circulating in the main circuit further includes exchanging thermal energy between the third heat exchanger and the lower portion of the accumulator.

Clause 21. The method in any of the preceding clauses, wherein the compressor is a vapor injection compressor, and wherein selectively directing the portion of the refrigerant fluid through the bypass circuit further includes directing the portion of the refrigerant fluid to an intermediate injection port of the vapor injection compressor.

Many modifications and other embodiments of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments disclosed and that modifications and other embodiments are intended to be included within the scope of the appended claims. Moreover, although the foregoing description and the associated figures describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A climate control system comprising:

a refrigerant circuit configured to route a refrigerant fluid within the climate control system, the refrigerant circuit including a main circuit and a bypass circuit;

the main circuit configured to direct the refrigerant fluid from a compressor to a first heat exchanger, a metering device, a second heat exchanger, and an accumulator;

the bypass circuit configured to selectively direct a portion of the refrigerant fluid from a location between the first and second heat exchangers to a third heat exchanger, the bypass circuit including a bypass control valve and a bypass metering device, the bypass control valve located upstream of the third heat exchanger and configured to control the flow of the portion of the refrigerant fluid to the third heat exchanger, the bypass metering device configured to lower a pressure of the portion of the refrigerant fluid before the portion of the refrigerant fluid enters the third heat exchanger; and the third heat exchanger, wherein the third heat exchanger is configured to exchange thermal energy between the portion of the refrigerant fluid and the refrigerant fluid in the main circuit while the portion of the refrigerant fluid is flowing in the bypass circuit, wherein the third heat exchanger is an insulated tube-in-tube heat exchanger that includes an inner fluid channel and an outer fluid channel, and wherein the third heat exchanger has a helical shape and is wrapped around the accumulator.

2. The climate control system of claim 1, further comprising:

a switch over valve that includes a heating mode position and a cooling mode position, the heating mode position configured to direct flow of the refrigerant fluid in the main circuit in a heating mode circuit that directs the refrigerant fluid from the second heat exchanger to the first heat exchanger, the cooling mode position configured to direct the flow of refrigerant in the main circuit in a cooling mode circuit that directs the refrigerant fluid from the first heat exchanger to the second heat exchanger; and control circuitry operably coupled to the switch over valve and the bypass control valve, the control circuitry configured to:

locate the switch over valve in the heating mode position when a heating mode call is received and in the cooling mode position when a cooling mode call is received;

open the bypass control valve to flow the portion of the refrigerant fluid in the bypass circuit while the heating mode call is received; and close the bypass control valve to stop the flow of the portion of the refrigerant fluid from flowing into the bypass circuit while the cooling mode call is received.

3. The climate control system of claim 2, wherein the control circuitry is operably coupled to a temperature sensor and is further configured to:

receive an indication of an outdoor ambient temperature from the temperature sensor; and close the bypass control valve to stop the portion of the refrigerant fluid from flowing into the bypass circuit while the heating mode call is received and the outdoor ambient temperature is above a threshold temperature.

4. The climate control system of claim 1, wherein the inner fluid channel directs the portion of the refrigerant fluid in the bypass circuit through the third heat exchanger, and the outer fluid channel directs the refrigerant fluid in the main circuit through the third heat exchanger.

5. The climate control system of claim 1, wherein the third heat exchanger is coupled to the accumulator.

6. The climate control system of claim 1, wherein an outer wall of the third heat exchanger abuts an outer wall of the accumulator.

7. The climate control system of claim 1, wherein the accumulator includes a lower portion and an upper portion, the lower portion being the portion of the accumulator that houses a liquid refrigerant fluid, the upper portion being the portion of the accumulator that houses a gas refrigerant fluid.

8. The climate control system of claim 1, wherein the compressor is a vapor injection compressor, and the bypass circuit directs the portion of the refrigerant fluid to an intermediate injection port of the vapor injection compressor after having passed through the third heat exchanger.

9. The climate control system of claim 1, wherein the insulated tube-in-tube heat exchanger has an asymmetrical design.

10. The climate control system of claim 1, wherein the insulated tube-in-tube heat exchanger has a symmetrical design.

11. A method of controlling refrigerant fluid flow in a climate control system, the method comprising:

circulating a refrigerant fluid in a refrigerant circuit of the climate control system using a compressor, the refrigerant circuit including a main circuit and a bypass circuit;

directing the refrigerant fluid in the main circuit from the compressor to a first heat exchanger, a metering device, a second heat exchanger, and an accumulator;

selectively directing a portion of the refrigerant fluid through the bypass circuit from a location between the first and second heat exchangers to a third heat exchanger using a bypass control valve, the bypass control valve located upstream of the third heat exchanger, wherein the third heat exchanger is an insulated tube-in-tube heat exchanger that includes an inner fluid channel and an outer fluid channel, and the third heat exchanger has a helical shape and is wrapped around the accumulator;

lowering a pressure of the portion of the refrigerant fluid before the portion of the refrigerant fluid enters the third heat exchanger using a bypass metering device; and exchanging thermal energy between the portion of the refrigerant fluid and the refrigerant fluid in the main circuit at the third heat exchanger while the portion of the refrigerant fluid is circulating in the bypass circuit.

12. The method of claim 11, wherein directing the refrigerant in the main circuit further includes directing the refrigerant fluid in one of either a heating mode circuit or a cooling mode circuit using a switch over valve, the heating mode circuit directing the refrigerant fluid from the second heat exchanger to the first heat exchanger, and the cooling mode circuit directing the refrigerant fluid from the first heat exchanger to the second heat exchanger, wherein selectively directing the portion of the refrigerant fluid in the bypass circuit includes opening the bypass control valve to allow the portion of the refrigerant fluid to flow in the bypass circuit while the switch over valve directs the refrigerant fluid in the main circuit in the heating mode circuit.

13. The method of claim 11, further comprising:

receiving an indication of an outdoor ambient temperature from a temperature sensor; and stopping the portion of the refrigerant fluid from flowing in the bypass circuit by closing the bypass control valve while a heating mode call is received and the outdoor ambient temperature is above a threshold temperature.

14. The method of claim 11, wherein directing the refrigerant in the main circuit further includes directing the refrigerant fluid in one of either a heating mode circuit or a cooling mode circuit using a switch over valve, the heating mode circuit directing the refrigerant fluid from the second heat exchanger to the first heat exchanger, and the cooling mode circuit directing the refrigerant fluid from the first heat exchanger to the second heat exchanger, wherein selectively directing the portion of the refrigerant fluid in the bypass circuit further includes stopping the portion of the refrigerant fluid from flowing into the bypass circuit by closing the bypass circuit while the switch over valve directs the refrigerant fluid in the main circuit in the cooling mode circuit.

15. The method of claim 11, further comprising:

directing the portion of the refrigerant fluid in the bypass circuit through the inner fluid channel of the third heat exchanger; and directing the refrigerant fluid in the main circuit through the outer fluid channel of the third heat exchanger.

16. The method of claim 11, further comprising directing the refrigerant fluid in the main circuit through an outer fluid channel of the third heat exchanger, the outer fluid channel including an outer wall of the third heat exchanger that abuts an outer wall of the accumulator.

17. The method of claim 11, wherein the accumulator includes a lower portion and an upper portion, the lower portion being the portion of the accumulator that houses a liquid refrigerant fluid, the upper portion being the portion of the accumulator that houses a gas refrigerant fluid.

18. The method of claim 11, wherein the insulated tube-in-tube heat exchanger has an asymmetrical design.

* * * * *